United States Patent [19]

Thuries et al.

[11] Patent Number: 5,001,314

[45] Date of Patent: Mar. 19, 1991

[54] HIGH TENSION CIRCUIT-BREAKER HAVING A DIELECTRIC GAS UNDER PRESSURE

[75] Inventors: Edmond Thuries, Meyzieu; Denis Dufournet, Bron; Michel Perret, Bourgoin-Jallieu, all of France

[73] Assignee: GEC Alsthom SA, Paris, France

[21] Appl. No.: 430,403

[22] Filed: Nov. 2, 1989

[30] Foreign Application Priority Data

Nov. 2, 1988 [FR] France ..... 88 14274

[51] Int. Cl.[5] ..... H01H 33/60

[52] U.S. Cl. ..... 200/148 B; 200/148 R; 200/148 A

[58] Field of Search ..... 200/148 B, 148 A, 148 R

[56] References Cited

U.S. PATENT DOCUMENTS 4,516,006 5/1985 Kobayashi et al. ..... 200/148 X
4,649,243 3/1987 Thuries ..... 200/148 A
4,774,388 9/1988 Thuries et al. ..... 200/148 A

FOREIGN PATENT DOCUMENTS 61992 10/1982 European Pat. Off. .
2403300 7/1975 Fed. Rep. of Germany .

*Primary Examiner*—Robert S. Macon
*Attorney, Agent, or Firm*—Sughrue, Mion, Zinn, Macpeak & Seas

[57] ABSTRACT

A high tension circuit breaker having a dielectric gas under pressure, the circuit breaker being of the type including at least one interrupting chamber comprising an insulating shell filled with the gas and containing a fixed assembly including a fixed main contact and a fixed arcing contact, a moving assembly including a moving main contact and a moving arcing contact, a blast cylinder opening out into a blast nozzle, and a pair of secondary contacts, the circuit breaker being characterized in that the blast cylinder is delimited by a first cylinder (5) constituting the moving arcing contact, a second cylinder (7) constituting the main moving contact, and a semi-moving first piston (14) carrying one of the secondary contacts, with the other secondary contact (31) being carried by a fixed tube (15) which, together with the first piston, an insulating tubular extension (5B) of the first cylinder (5), and a second piston fixed to the cylinder (5) and sliding along the fixed tube, delimits a second closed volume (35).

8 Claims, 2 Drawing Sheets

HIGH TENSION CIRCUIT-BREAKER HAVING A DIELECTRIC GAS UNDER PRESSURE

The present invention relates to a high tension circuit breaker in which the interrupting chamber is filled with dielectric gas such as sulfur hexafluoride, and in which the energy of the arc is used via the pressure increase it imparts to the gas to reduce the external drive energy required for interruption purposes.

The invention relates more particularly to a circuit breaker having a blast cylinder and a second chamber in which a pair of additional contacts is capable of generating a secondary arc while the circuit breaker is opening for the purpose of contributing energy to that used for driving the opening operation.

A circuit breaker of this type is described, for example, in French patent number 8701545.

A problem to be solved in this type of circuit breaker is to ensure that the pressure inside the blast cylinder remains low when interrupting low currents (since low external drive energy is sufficient) while nevertheless ensuring that the pressure is high for interrupting high currents without requiring the external drive energy to be increased.

An object of the present invention is to provide a circuit breaker in which the external drive energy remains low even when interrupting low currents. Another object of the invention is to provide a circuit breaker in which no arc is struck on re-closure in the thermal volume.

Another object of the invention is to allow the driving arc in the thermal volume to elongate and therefore deliver more energy if the current is very high.

The present invention provides a high tension circuit breaker having a dielectric gas under pressure, the circuit breaker being of the type including at least one interrupting chamber comprising an insulating shell filled with said gas and containing a fixed assembly including a fixed main contact and a fixed arcing contact, a moving assembly including a moving main contact and a moving arcing contact, a blast cylinder opening out into a blast nozzle, and a pair of secondary contacts, the circuit breaker being characterized in that said blast cylinder is delimited by a first cylinder constituting the moving arcing contact, a second cylinder constituting the main moving contact, and a semi-moving first piston carrying one of the secondary contacts, with the other secondary contact being carried by a fixed tube which, together with said first piston, an insulating tubular extension of said first cylinder, and a second piston fixed to said cylinder and sliding along said fixed tube, delimits a second closed volume.

The invention will be well understood from the following description of a preferred embodiment of a circuit breaker in accordance with the invention, in which.

Figure 1:
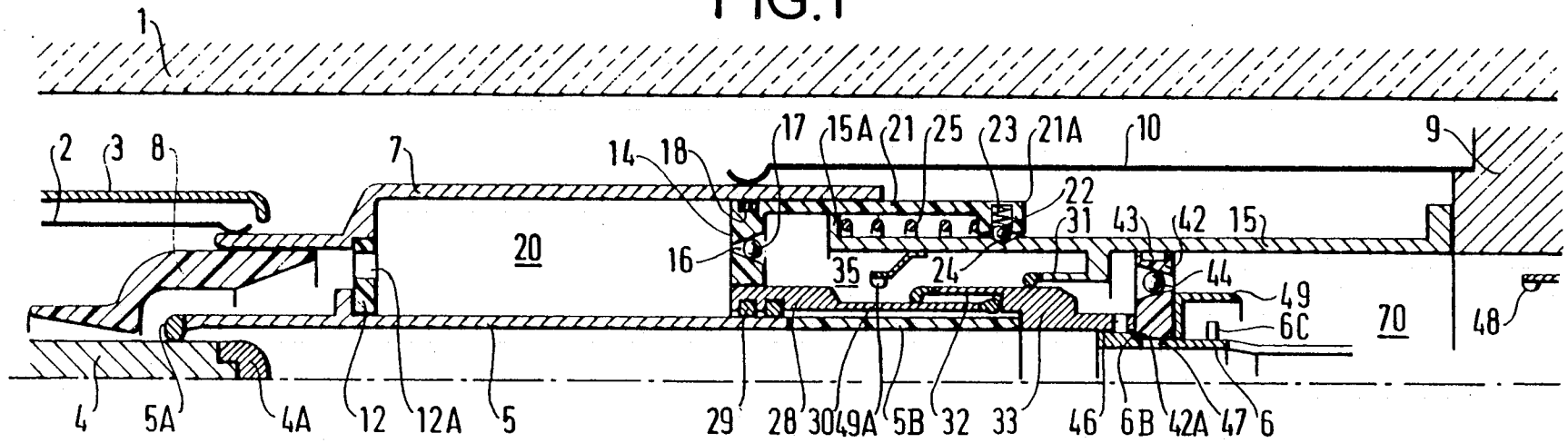
FIG. 1 is a fragmentary axial half-section view of the interrupting chamber of a circuit breaker of the invention in the current-passing position.

FIG. 1 shows an interrupting chamber comprising a shell 1 made of an insulating material such as a ceramic, and filled with a dielectric gas such as sulfur hexafluoride at a pressure of a few bars. Inside the shell, there is an assembly comprising a main fixed contact constituted by contact fingers 2 protected by an anti-corona cap 3, and an arcing contact constituted by a metal tube or cylinder 4 terminated by an endpiece 4A made of an alloy which withstands the effects of arcing.

The moving equipment comprises a metal tube or cylinder 5 serving as the moving arcing contact, and terminated by an endpiece 5A made of an alloy which withstands the effects of arcing.

The tube 5 is driven by a metal tube 6, e.g. made of aluminum, and fixed to a drive rod (not shown). The tubes 5 and 6 are not fixed to each other, and on the contrary a degree of lost motion is provided between them. Drive takes place via a step 6B on the tube 6 and a step 42A on a piston 42 described below. The lost motion is limited by an abutment 6C.

A metal tube 7 disposed concentrically about the tube 5 serves as a the moving main contact.

It has a blast nozzle 8 made of insulating material. It is in electrical contact via contact fingers 10 with a metal block 9 which is fixed to the fixed equipment and made of aluminum, for example.

The tube 5 and the tube 7 are held together by an insulating ring 12 pierced by holes 12A.

The volume 20 delimited by the tubes 5 and 7 is closed by fixed piston 14 made of an insulating material such as polytetrafluoroethylene, or some other material which is held in place by a metal tube 15 fixed to the block 9.

The volume delimited by the tubes 5 and 7, the ring 12 and the piston 14 is referenced 20. This volume constitutes the blast cylinder of the circuit breaker.

The piston 14 is pierced by orifices 16 each including a non-return valve 17 allowing gas to flow only out from the inside of the volume 20. The piston 14 includes a sealing ring 18.

The piston 14 is free to move relative to the fixed part 15. To this end, it is fixed to a tube 21 which slides against the tube 7 and which has an abutment comprising a ball 22 and a spring 23 or any other appropriate system for co-operating with a notch 24 formed in the tube 15. A spring 25 working in compression is disposed between a ring 15A at the end of the part 15 and a ring 21A at the end of the tube 21.

The piston 14 does not slide directly over the tube 5 but via a block 28 provided with an electrical contact 29 and terminated by a cylinder 30 constituting one of the secondary contacts. The other secondary contact 31 is fixed to the tube 15. An electrode 32 is carried by a metal block 33 extending the tube 5 and separated therefrom by a tubular portion 5B made of insulating material.

The volume 35 delimited by the tube 15, the piston 14, the block 28, and the contacts 30 and 31 is closed by an insulating piston 42 which is fixed to the tube 5 and which includes a guide segment 43 and a non-return valve 44 allowing gas to flow only from the outside into the volume 35.

The end of the block 33 has holes 46. Similarly, the tube 6 has holes 47. The function of these holes is described below.

The part 9 has a contact 48 co-operating with one end 49 of the tube 5 in order to put the block 33 at the same potential as the remainder of the moving equipment at the end of the opening stroke.

An electrode 49A carried by the fixed part 15 serves, at the end of the opening operation, to put the block 28 at the potential of the part 15.

The circuit breaker operates as follows.

When the circuit breaker is closed (position shown in FIG. 1), current flows via the fingers 32, the tube 7, the fingers 10, and the part 9.

Interrupting Low Currents

Figure 2:
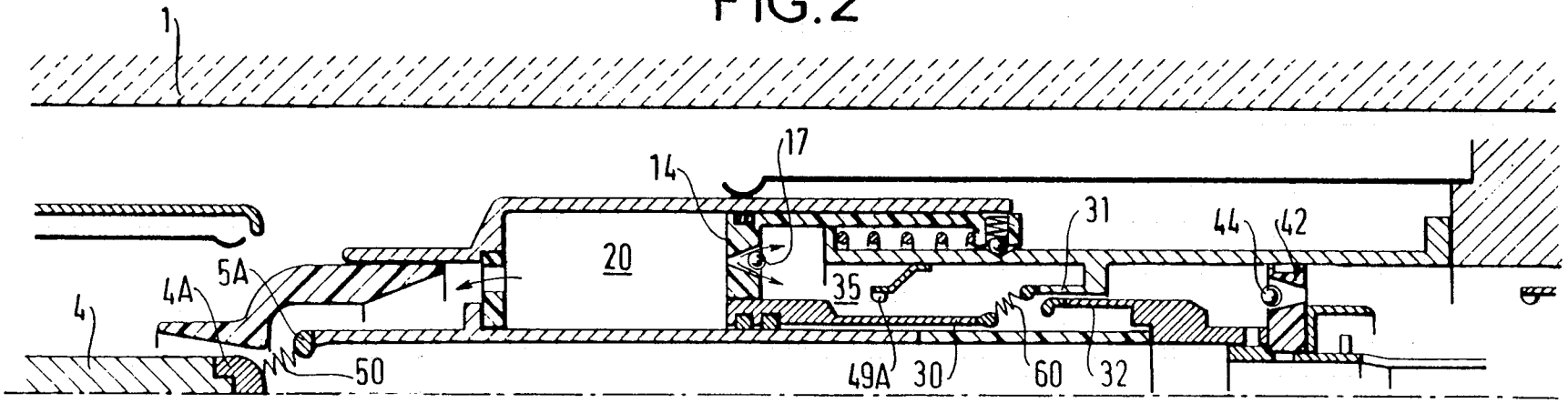
FIG. 2 is a similar view showing an opening operation while interrupting a low current.

Low currents are currents that are less than or equal to the nominal current of the installation. When the circuit breaker is opened (FIG. 2), the moving equipment is drawn by the tube 6. When the contacts separate, an arc 50 is struck between arcing contacts 4A and 5A.

Nearly simultaneously, an arc 60 is struck between the secondary contacts 30 and 32, and it then switches over to the contact 31. The current then flows via the contact 4, the arc 50, the tube 5, the block 28, the contacts 30, the arc 60, the contacts 31, the tube 15, and the block 9. The arc 60 is a low energy arc and the increase in pressure in the volume 35 is insufficient to displace the piston 14 relative to the tube 15.

There is little increase in pressure inside the volume 20 because the non-return valve 17 opens.

The blast is nevertheless sufficient to extinguish the arc 50 on the first zero pass of the current. The external drive energy is low.

Interrupting High Currents

High currents are short circuit currents.

Figure 3:
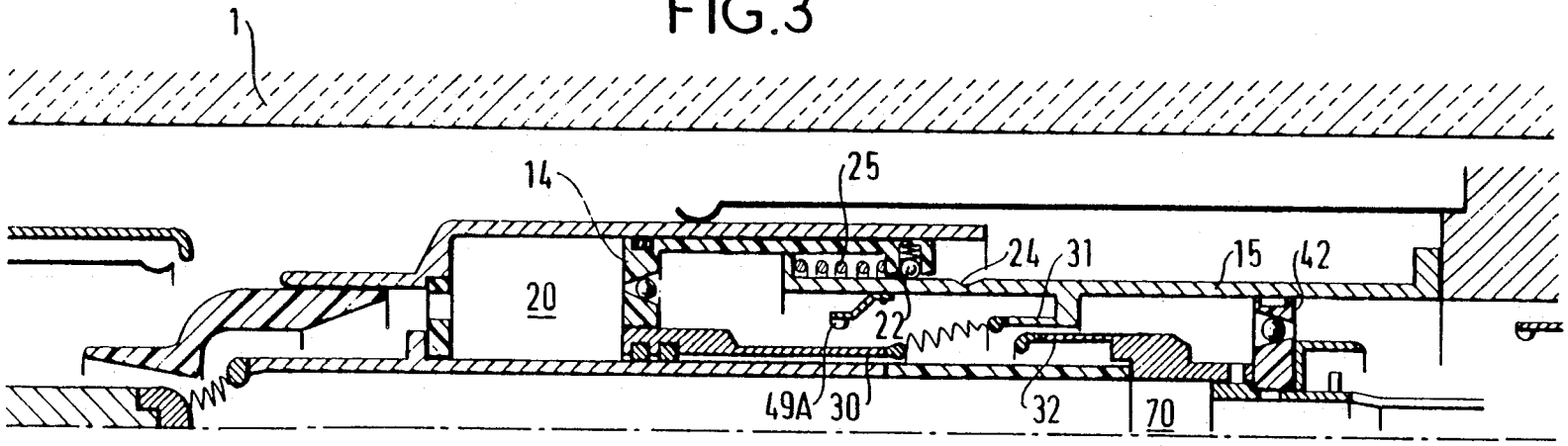
FIG. 3 is a similar view showing an opening operation while interrupting a high current.

FIG. 3 shows the circuit breaker while opening by virtue of the tube 6 moving to the right of the figure.

The very high intensity arc 60 rapidly heats up the volume 35 and gives rise to a corresponding very large increase in the gas pressure inside this volume. This increase in pressure has three effects:

its first effect is to close the non-return valves 17;

its second effect is to displace the piston 14 relative to the fixed tube 15.

The ball 22 leaves the notch 24 and the spring 25 is compressed. The displacement of the piston resulting from the superposition of two motions, one relative to the tube 15 and the other relative to the moving assembly, compresses the gas in the volume 20 very rapidly and gives rise to a very energetic blast.

The elongation of the arc due to the additional distance which arises between the contacts 30 and 31 serves to heat the gas in the volume 35 even more.

The third effect of the increase of gas pressure inside the volume 35 is to exert considerable pressure on the piston 42 fixed to the moving equipment, thereby imparting additional energy to the drive for opening the circuit breaker.

At the end of the opening stage, the spring 25 returns the piston 14 until the ball 22 springs back into the notch 24.

Figure 4:
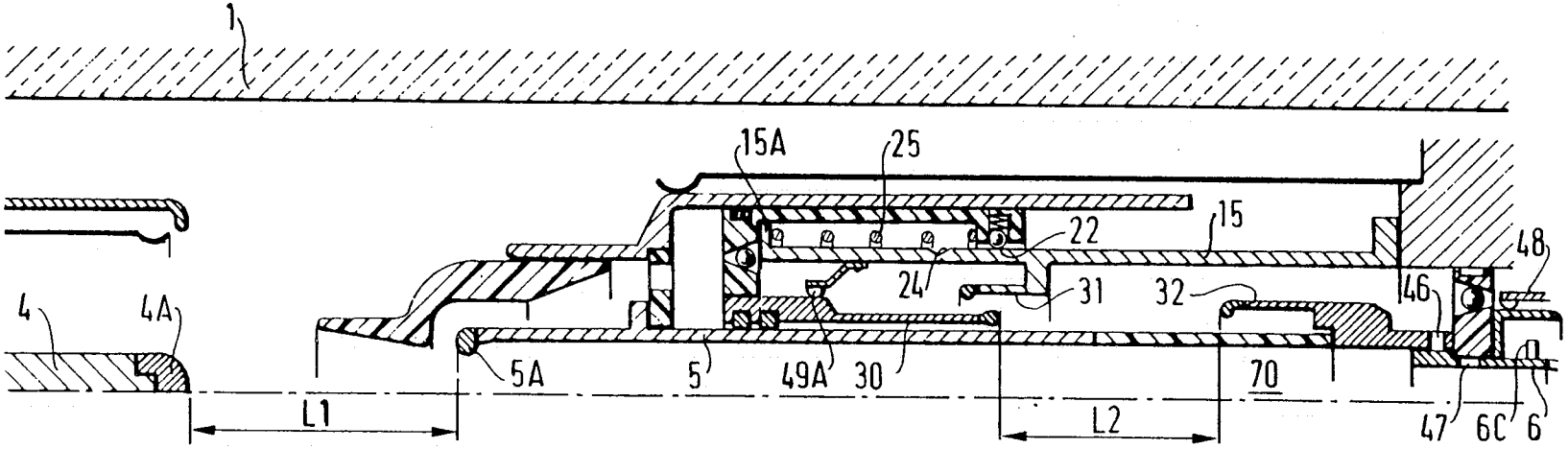
FIG. 4 is a similar view showing the end of the opening operation.

At the end of an opening movement (FIG. 4) the blast cylinder pushes the piston 14 and causes the ball 22 to escape from its notch 24. Under the action of the spring 25, the piston 14 moves until it comes into abutment at 15A, thereby also displacing the electrode 30 fixed to the piston 14.

The distance L2 between the electrode 32 and the auxiliary contact 30 is then less than the distance L1 between the arcing contacts 4A and 5A.

As a result, when re-engaging the circuit breaker, no arcing occurs inside the closed volume 35.

Closing the Circuit Breaker

The tube 6 is driven to the left in the figure. The abutment 6C drives the tube 5. The slight increase in pressure inside the volume 35 is released into the volume 70 inside the 5 tube 5 via the holes 46 and 47 when they come into coincidence.

At the end of the closure operation, the circuit breaker has returned to the configuration shown in FIG. 1.

Any resistance that could arise due to a pressure drop in the chamber 20 is avoided by the non-return valve 17 opening.

We claim:

1. A high tension circuit breaker having a dielectric gas under pressure, the circuit breaker being of the type including at least one interrupting chamber comprising an insulating shell filled with said gas and containing a fixed assembly including a fixed main contact and a fixed arcing contact, a moving assembly including a moving main contact and a moving arcing contact, a blast cylinder opening out into a blast nozzle, and a pair of secondary contacts, the circuit breaker being characterized in that said blast cylinder is delimited by a first cylinder (5) constituting the moving arcing contact, a second cylinder (7) constituting the main moving contact, and a semi-moving first piston (14) carrying one of the secondary contacts, with the other secondary contact (31) being carried by a fixed tube (15) which, together with said first piston, an insulating tubular extension (5B) of said first cylinder (5), and a second piston fixed to said cylinder (5) and sliding along said fixed tube, delimits a second closed volume (35).

2. A circuit breaker according to claim 1, characterized in that said semi-moving piston (14) is connected to said tube (15) by ball snap-fastening means (32, 33) or by analogous means co-operating with a notch (24) in said tube, said piston being subjected to the action of a spring (25) tending to urge said ball into said notch.

3. A circuit breaker according to claim 1, characterized in that said semi-moving piston (14) includes a non-return valve allowing gas to flow only from the inside of the blast cylinder towards the outside.

4. A circuit breaker according to claim 1, characterized in that it includes an electrode fixed to the fixed assembly and electrically connected to the fixed contacts, said electrode being disposed inside said second volume (35).

5. A circuit breaker according to claim 4, characterized in that the secondary contacts (30, 31) are disposed in such a manner that when the circuit breaker is open, with said semimoving piston in abutment against the tube (15), the distance (L2) between the ends of said secondary contacts is less than the distance between the ends of the arcing contacts (4A, 4B).

6. A circuit breaker according to claim 1, characterized in that the fixed assembly carries a contact (48) making contact with the tube (5) constituting the moving arcing contact when the circuit breaker is open.

7. A circuit breaker according to claim 1, characterized in that said annular end piston (42) includes a non-return valve (44) allowing gas to flow only from the outside into the inside of the volume (35) containing the secondary contacts (30, 31).

8. A circuit breaker according to claim 1, characterized in that the tube (5) constituting the moving arcing contact is connected to a drive tube (6) with a degree of lost motion so as to cause holes (46) made through the part (33) extending the moving arcing contact to come into coincidence, when the circuit breaker is being closed, with holes (47) made through said drive tube (6) in order to evacuate the increase of pressure inside the volume (35) containing the secondary contacts (30, 31).

* * * * *